United States Patent [19]

Hagemeister

[11] Patent Number: 4,721,290

[45] Date of Patent: Jan. 26, 1988

[54] BENT WIRE SPRING UNIT

[75] Inventor: Robert C. Hagemeister, Boston, Mass.

[73] Assignee: Webster Spring Co. Inc., Oxford, Mass.

[21] Appl. No.: 35,271

[22] Filed: Apr. 2, 1987

Related U.S. Application Data

[63] Continuation of Ser. No. 675,892, Nov. 28, 1984, abandoned.

[51] Int. Cl.[4] ..... F16F 3/00

[52] U.S. Cl. ..... 267/103; 5/247; 5/260

[58] Field of Search ..... 267/103, 104, 105, 106, 267/107, 108, 109; 5/247, 255, 267, 260, 272, 273, 276

[56] References Cited

U.S. PATENT DOCUMENTS

| | | | |
|---|---|---|---|
| 3,612,505 | 10/1971 | Bond | 267/107 |
| 3,754,744 | 8/1973 | Ciampa et al. | 267/108 X |
| 4,339,834 | 7/1982 | Mizelle | 5/255 |

*Primary Examiner*—George E. A. Halvosa
*Assistant Examiner*—Matthew C. Graham
*Attorney, Agent, or Firm*—Robert T. Gammons

[57] ABSTRACT

A bent wire soring unit for disposition between a base frame and grid frame disposed in spaced, parallel relation to each other includes a lower attaching element for attachment to the base frame and an upper attaching element for attachment to the grid frame. The lower and upper attaching elements are disposed in spaced, parallel planes and transversely-spaced, substantially perpendicular supports connect the lower and upper attaching elements such as to permit the upper and lower attaching elements to move relative to each other in response to pressure applied perpendicularly to the upper attaching elements.

1 Claim, 7 Drawing Figures

BENT WIRE SPRING UNIT

This is a continuation of co-pending application Ser. No. 675,892, filed on Nov. 28, 1984, now abandoned.

BACKGROUND OF THE INVENTION

Bed springs for beds are generally constructed of a rigid base frame comprised of wood and a wire grid frame supported in substantially spaced, parallel relation to the base frame by a plurality of longitudinally and transversely-spaced rows of spring units which may be in the form of coils of wire or in the form of bent wire or a combination thereof attached at their lower ends to the base frame and at their upper ends to the grid frame. It is the purpose of this invention to provide spring units of the bent wire type of improved construction for use exclusively or in combination with coil spring units structured to provide soft, relatively deep controlled yield without the sacrifice of stability, as opposed to yield which is stiffly resistant to displacement and, hence, not conductive to comfort.

SUMMARY OF THE INVENTION

As herein illustrated, the bent wire spring unit is structured to be disposed between a base frame and a grid frame and to be attached thereto at its lower and upper ends, respectively, and comprises vertically-spaced, substantially parallel upper and lower attaching elements and transversely-spaced, substantially perpendicular supports connecting the upper and lower attaching elements such as to permit the upper and lower attaching elements to move relative to each other in response to pressure applied perpendicularly to the upper attaching element. Each support comprises a V-shaped length of wire positioned between the upper and lower attaching elements with the apices of the V-shaped length of wire situated between the top and bottom attaching elements and with the extremities of the legs of the V-shaped lengths of wire integrally connected to the top and bottom attaching elements. In accordance with the invention, the upper legs of the V-shaped lengths of wire are longer than the lower legs of the V-shaped lengths of wire such that the apices of the V-shaped lengths of wire are situated at a vertical distance below the upper attaching element which is greater than the vertical distance from the lower attaching element. The upper attaching elements comprise in the same plane, spaced, parallel lengths of wire containing notches and are connected at opposite ends, respectively, by an in the same plane diagonal length of wire and to the upper ends of the support. The bottom attaching element comprises in the same plane, spaced, parallel straight lengths of wire connected at opposite ends, respectively, by an in the same plane diagonal length of wire and to the lower ends of the supports. The legs of the V-shaped lengths of wire are bent at their upper and lower ends at their junctions with the upper and lower elements such that portions thereof are inclined to the upper and lower attaching elements at obtuse angles to the legs of the V-shaped lengths of wire. Desirably, the apex angles of the V-shaped lengths of wire are approximately 68 degrees.

The invention will now be described in greater detail with reference to the accompanying drawings, wherein.

Figure 6:
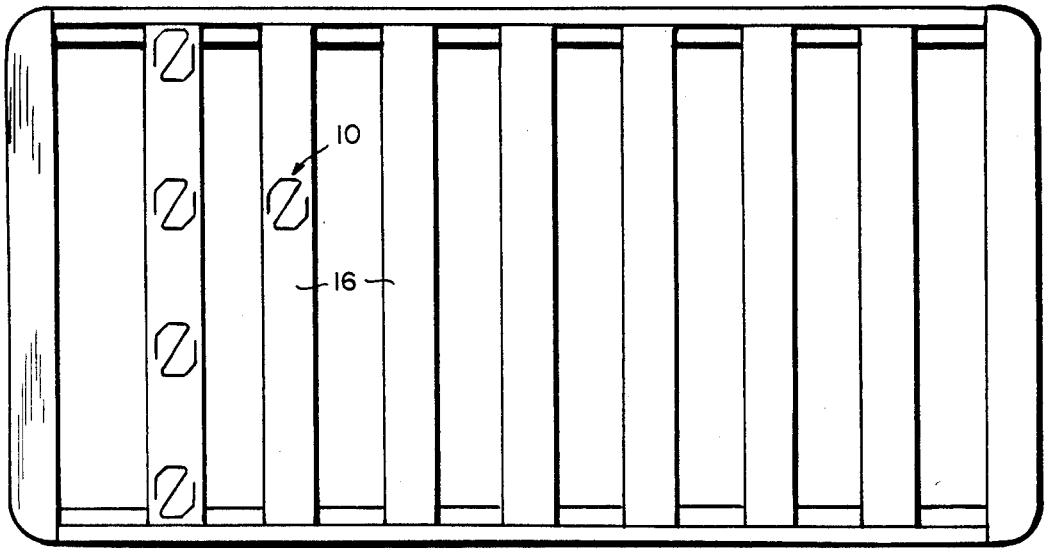
FIG. 6 is a plan view of a base frame showing the spring units positioned on the transverse supporting bars of the base frame.
Figure 7:
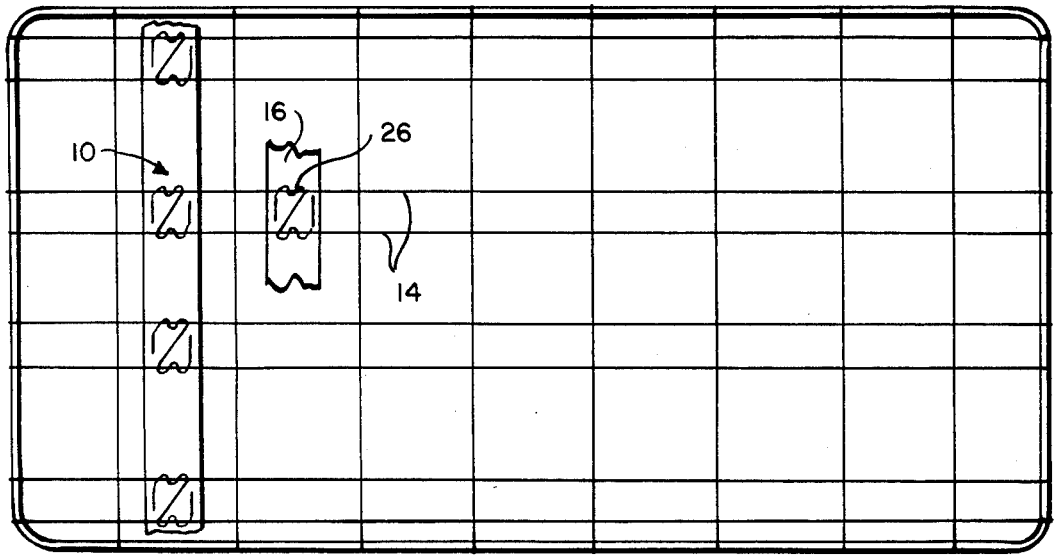
FIG. 7 is a plan view of the grid frame showing the upper ends of the spring units attached to the longitudinally-extending grid wires.

Referring to FIGS. 6 and 7, bent wire spring units 10 structured according to this invention are shown disposed between the longitudinal wires 14—14 of a rectangular grid frame 6, FIG. 7, comprised of a rectangular border wire and crossing wires 14 and the transverse support bars 16 of a rectangular base frame 8, FIG. 6. The bent wire spring units 10 may be used exclusively throughout the entire spring assembly or in combination with coil springs.

Figure 1:
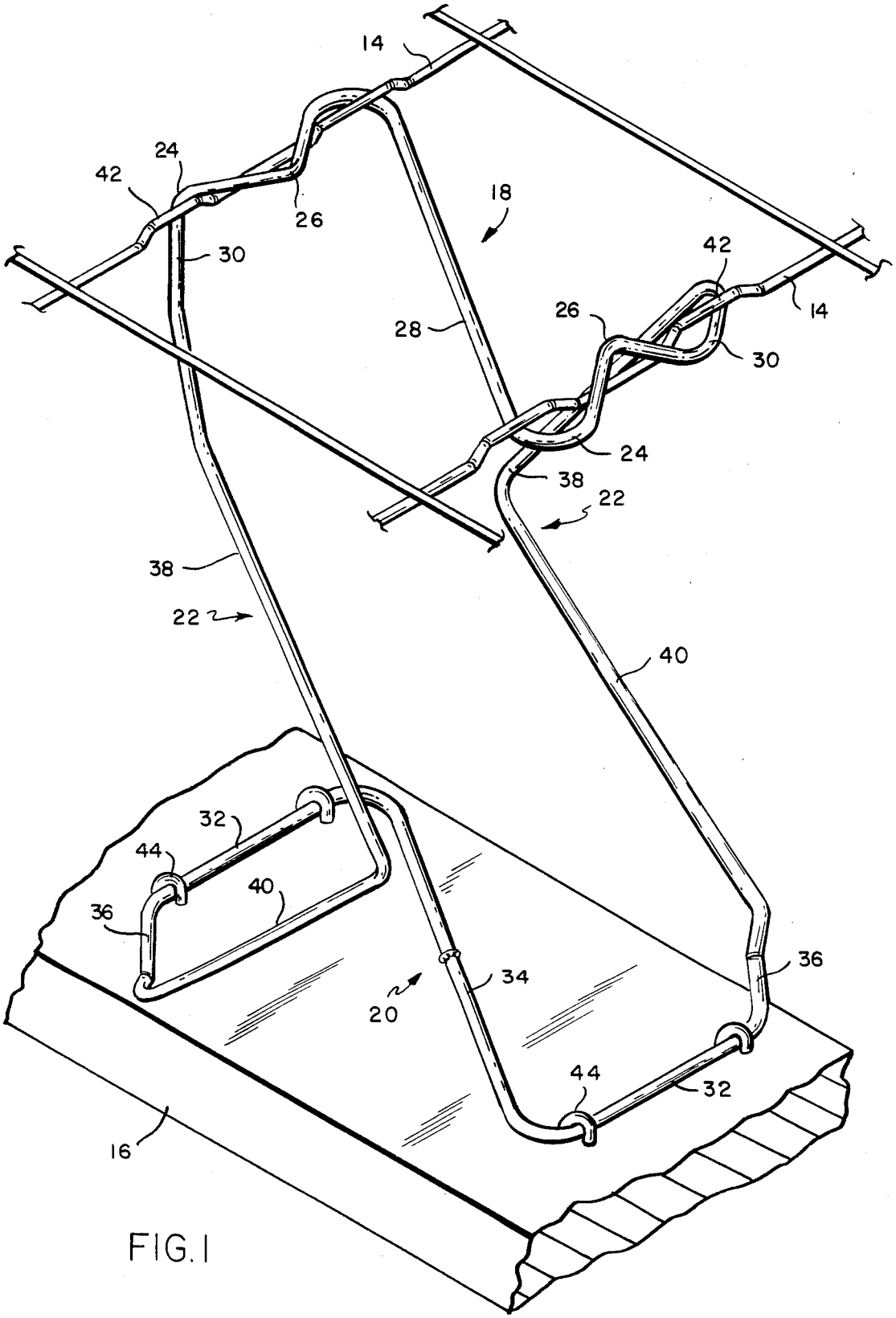
FIG. 1 is a perspective of the spring unit of this invention shown interposed between and attached to a base frame and a grid frame.
Figure 2:
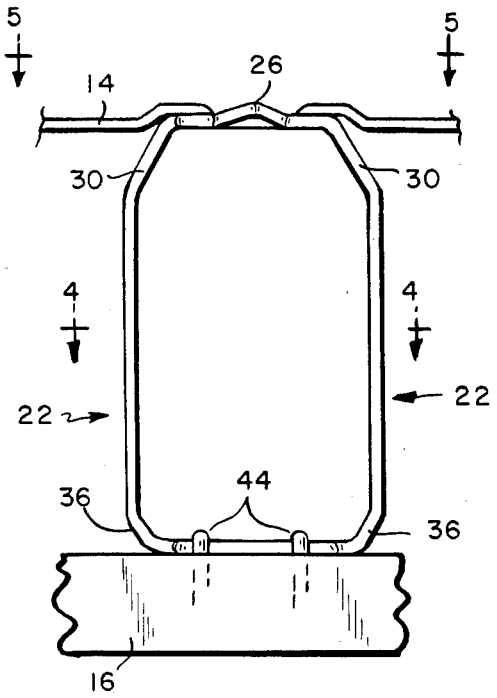
FIG. 2 is an elevation of a spring unit as seen from one side with its lower end attached to a support bar of a base frame and its upper end attached to a grid frame.
Figure 3:
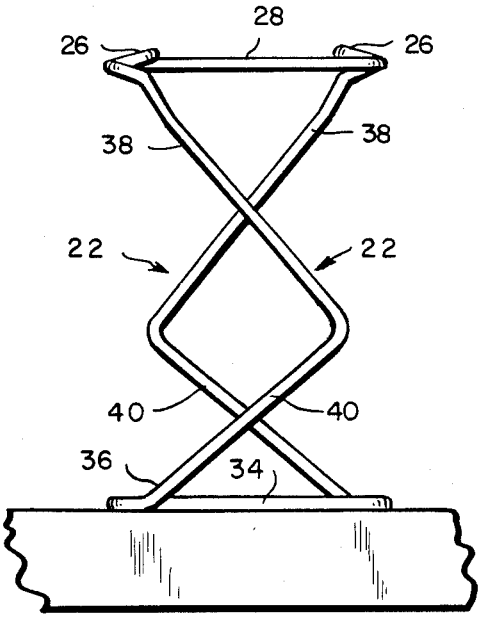
FIG. 3 is an elevation taken at right angles to FIG. 2.
Figure 4:
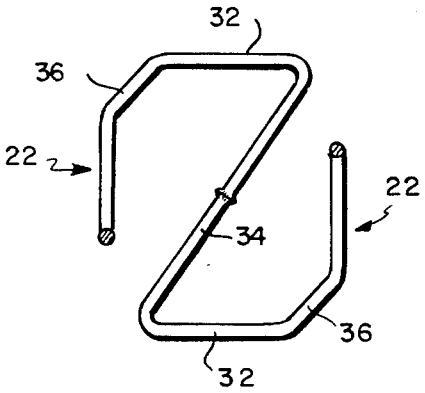
FIG. 4 is a horizontal section taken on the line 4—4 of FIG. 2.
Figure 5:
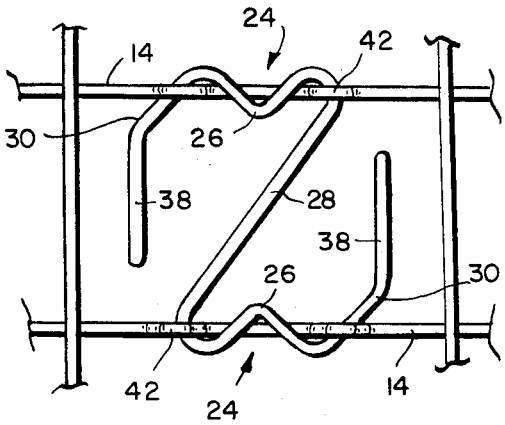
FIG. 5 is a plan view taken on the line 5—5 of FIG. 2.

Each bent wire spring unit 10 as shown in FIG. 1 comprises an upper attaching element 18, a lower attaching element 20 and interposed yieldable supports 22—22 which permit yield of the upper and lower attaching elements relative to each other. More specifically, the upper attaching element 18 comprises spaced lengths of wire 24—24 containing deviations 26—26. Opposite ends of the lengths 24—24 are connected at one end to a diagonal length of wire 28 and at their other ends to the supports 22—22 by downwardly and laterally-inclined lengths of wire 30—30. The lower attaching element 20 comprises spaced, parallel lengths of wire 32—32 connected one end to the opposite ends of a diagonal length of wire 34 and at their other ends to the supports 22—22 by lengths of wire 36—36 bent into the plane of the straight lengths of wire 32—32 and bent inwardly relative to the supports. The supports 22—22 comprise upper inclined lengths of wire 38—38 and lower lengths of wire 40—40. The V-shaped lengths of wire constituting the supports 22—22 are disposed in oppositely-facing, spaced, parallel relation to each other and connected at their upper ends by the lengths of wire 30—30 to the upper attaching elements and at their lower ends by the lengths of wire 36—36 to the lower attaching element.

As shown in FIGS. 1 and 7, the upper attaching elements 18 are attached to the adjacent longitudinal grid wires 14 by the deviations 26—26 which extend toward each other and which are interengaged with deviations 42—42 formed in the wires 14. The deviations for securing the upper attaching elements to the wires are like those shown in U.S. Pat. No. 4,004,304. The lower attaching element 20 are attached to the support bars 16 by means of staples 44 driven into the bar over the lengths of wires 32—32.

The upper lengths of wire 38 of the V-shaped lengths of wire are appreciably longer than the lower lengths 40—40 of the V-shaped length of wire so that the apices of the V-shaped lengths of wire are at a greater perpendicular distance from the upper attaching element than from the lower attaching element, thus providing for relatively long lever arms above the apices in contrast to the shorter level arms below the apices. Thus structured, the yield to pressure applied perpendicularly to the upper attaching element is through a greater distance than that of the lower arms relative to the lower attaching element which provides for a softer and deeper yield. Because of the structural configuration, the yield embodies bending at the apices of the supporting structures 22—22 and torsion at the ends of the arms connected to the bottom and top attaching elements.

As previously mentioned, the spring units illustrated can be used exclusively or in combination with coil spring units.

It should be understood that the present disclosure is for the purpose of illustration only and includes all modifications or improvements which fall within the scope of the appended claims.

What is claimed is:

1. A bent wire spring unit for disposition between a base frame and a grid frame disposed in spaced, parallel relation to each other, comprising a lower attaching element for attaching it to the base frame and an upper attaching element for attaching it to the grid frame, said lower and upper attaching elements being disposed in spaced, parallel planes and said upper attaching element comprising in the the same plane, longitudinally-spaced, bent lengths of wire and said lower attaching element comprising in the same plane, longitudinally-spaced, parallel, straight lengths of wire, a first diagonal length of wire connected at its opposite ends to the opposite ends of the longitudinally-spaced, bent lengths of wire of the upper attaching element, a second diagonal length of wire connected at its opposite ends to the corresponding opposite ends of the longitudinally-spaced, parallel, straight lengths of wire of the lower attaching element such that the diagonal lengths of wire of the upper attaching element and the lower attaching element are situated in a common plane perpendicular to the upper and lower attaching elements, and transversely-spaced, parallel, substantially perpendicular supports connecting the lower and upper attaching elements such as to permit the upper and lower attaching elements to move relative to each other in response to pressure applied perpendicularly to the upper attaching element, said supports comprising transversely-spaced, parallel, vertically-disposed, V-shaped lengths of wire, each embodying exclusively diverging, straight upper and lower legs disposed exclusively in a common plane perpendicular to the attaching elements with the legs of one of the V-shaped lengths of wire facing in a direction opposite to the legs of the other V-shaped length of wire and with the extremities of the upper legs of V-shaped lengths of wire integrally connected with the upper attaching element and the extremities of the lower legs integrally connected with the lower attaching element, said upper legs being of greater length than said lower legs so that the apices of the V-shaped lengths of wire being situated closer to the lower attaching elements than to the upper attaching elements and wherein the apices extend transversely with respect to the parallel lengths of wire of the upper and lower attaching elements a distance less than the distance between said longitudinally-spaced lengths of wire of said upper and lower attaching elements and wherein the V-shaped lengths of wire lap each other in spaced, parallel planes such that said upper legs cross each other in opposite directions in said vertical, spaced, parallel planes and said lower legs cross each other in opposite directions in said vertically-spaced, parallel planes.

* * * * *